United States Patent [19]

Knopp et al.

[11] 4,295,253

[45] Oct. 20, 1981

[54] PROCESS AND APPARATUS FOR TEXTURIZING FILAMENT BUNDLES

[75] Inventors: Hans Knopp, Ludwigshafen; Dieter Herion, Frankenthal; Gerhard Conzelmann, Otterstadt; Heinz Gehrig, Kaiserslautern, all of Fed. Rep. of Germany

[73] Assignee: BASF Aktiengesellschaft, Ludwigshafen, Fed. Rep. of Germany

[21] Appl. No.: 79,327

[22] Filed: Sep. 27, 1979

[30] Foreign Application Priority Data

Oct. 12, 1978 [DE] Fed. Rep. of Germany ..... 2844391

[51] Int. Cl.[3] ..... D02G 1/12; D02G 1/16

[52] U.S. Cl. ..... 28/255

[58] Field of Search ..... 28/255

[56] References Cited

U.S. PATENT DOCUMENTS

| | | | |
|---|---|---|---|
| 3,458,987 | 8/1969 | Ozawa et al. | 28/271 X |
| 3,583,140 | 6/1971 | Lorenz et al. | 28/272 X |
| 3,714,686 | 2/1973 | Schmid et al. | 28/255 |
| 3,751,775 | 8/1973 | Psaras . | |
| 3,828,404 | 8/1974 | Peckinpaugh et al. . | |
| 3,874,044 | 4/1975 | Kwon et al. | 28/255 X |
| 3,875,625 | 4/1975 | Blanc et al. . | |
| 3,889,327 | 6/1975 | Joly et al. . | |
| 3,908,248 | 9/1975 | Schmid et al. | 28/255 |
| 3,958,310 | 5/1976 | Blanc et al. . | |
| 4,014,084 | 3/1977 | Bauer et al. | 28/255 |
| 4,112,658 | 9/1978 | Morihashi . | |
| 4,120,078 | 10/1978 | Martin et al. | 28/255 X |
| 4,148,179 | 4/1979 | Becker et al. | 28/255 X |

FOREIGN PATENT DOCUMENTS

| | | | |
|---|---|---|---|
| 805867 | 2/1969 | Canada | 28/255 |
| 2416205 | 10/1974 | Fed. Rep. of Germany . | |
| 2545590 | 4/1977 | Fed. Rep. of Germany | 28/255 |
| 2803619 | 8/1978 | Fed. Rep. of Germany . | |

*Primary Examiner*—Robert Mackey

*Attorney, Agent, or Firm*—Keil & Witherspoon

[57] ABSTRACT

A process for texturizing bundles of filaments of synthetic high molecular weight materials at high speed, wherein the filament bundle is passed through a feed nozzle and is then brought into contact with a hot gaseous medium which is undergoing a vortical motion and has acquired a vortex angle of from 10° to 70° as a result of passage through a vortex chamber, is then heated by the fluid medium in a downstream tubular chamber and is subsequently fed to an expansion stage to produce the crimp, and apparatus for carrying out this process.

7 Claims, 3 Drawing Figures

PROCESS AND APPARATUS FOR TEXTURIZING FILAMENT BUNDLES

BACKGROUND OF THE INVENTION

1. Field of the Invention

The present invention relates to a process for texturizing filament bundles and to suitable apparatus for carrying out this process.

2. Description of the Prior Art

It is known in principle that bundles of filaments of synthetic high molecular weight materials can be crimped and entangled by passing the filament bundles through a feed nozzle, then contacting them with a hot fluid medium, passing them through a tubular chamber in order to heat them to the plasticizing temperature, and then passing them into an expansion zone to produce crimping, with or without entangling. German Published Application DAS No. 2,006,022, for example, describes a suitable apparatus, in which the expansion zone is in the shape of a tube with longitudinal slits. It is also known that the hot fluid medium may be passed through a centering body for the tubular chamber in the nozzle (cf. U.S. Pat. No. 3,714,686). Further, it is known that a vortical motion may be imparted to the hot fluid medium (German Laid-Open Application DOS No. 2,632,384).

OBJECTS AND SUMMARY OF THE INVENTION

It is an object of the invention to provide a process for texturizing bundles of filaments which process gives improved crimp rigidity.

It is another object of the invention to provide a process for texturizing bundles of filaments using a higher yarn intake tension upstream of the yarn feed.

It is a further object of the invention to provide a process for texturizing bundles of filaments by which even bundles of filaments containing small loops can be processed.

We have found a process for texturizing bundles of filaments of synthetic high molecular weight materials at high texturizing speeds, in which the filament bundle is passed through a feed nozzle, encounters a hot gaseous medium which is in vortical motion, is heated by this medium in a downstream tubular chamber and is then fed to an expansion stage to produce the crimp, in which process a vortex angle of from 10° to 70°, preferably from 20° to 50°, is imparted to the hot medium, which is to be given a vortical motion, by passage through a vortex inducer.

The vortex angle is here defined as the angle between the tangent to a helix which results on twisting a previously straight generating line of a cylinder (or cone), and a line, parallel to the axis, which intersects the tangent.

It is surprising that not only is a crimped and entangled yarn obtained, as expected, but that in addition the yarn exhibits a better crimp rigidity than a texturized yarn produced similarly but without a vortical motion at the stated vortex angle. A further advantage is that the process can be carried out at a somewhat lower temperature than is employed in a process without the specific vortical motion. Surprisingly, the yarn intake tension upstream of the yarn feed nozzle increases, under the action of the directional vortical motion, by a factor of 2 or even more. Hence, even a feed yarn with a small proportion of loops can be processed without problems, while such loops interfere with the process in the absence of the specific vortical motion of the hot fluid medium.

The invention further relates to an apparatus for the texturizing of bundles of filaments of synthetic high molecular weight materials, which comprises a feed nozzle for the filament bundle, one or more feeds whereby a hot fluid medium can reach the filament bundle, the feeds being so constructed that they impart a vortical motion to the fluid medium, a downstream tubular chamber in which the filament bundle is heated by means of the hot gaseous medium, and an expansion stage, in which apparatus the vortex inducer or inducers in the feed for the hot fluid medium are so constructed as to impart a vortex angle of from 10° to 70°, in particular of from 20° to 50°, to the said medium.

BRIEF DESCRIPTION OF THE DRAWING

Embodiments of the invention will now be described with reference to the accompanying drawing in which.

DESCRIPTION OF THE PREFERRED EMBODIMENTS

Figure 1:
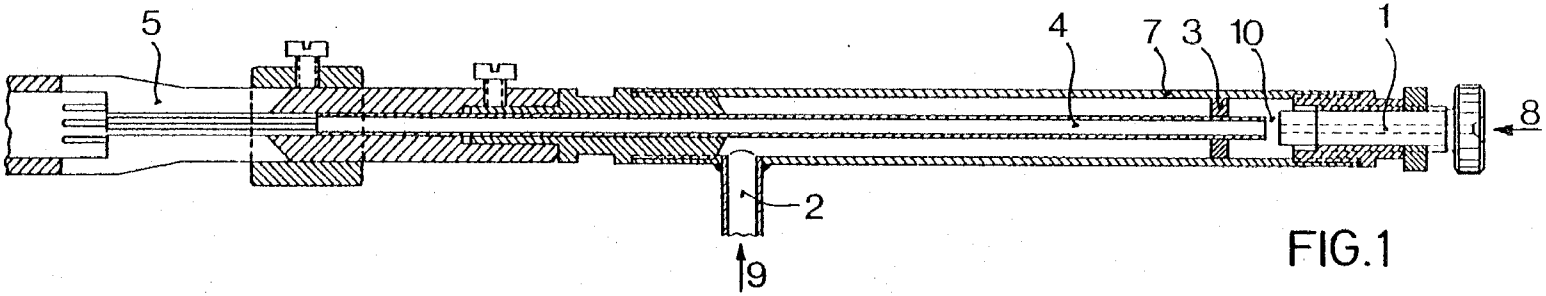
FIG. 1 is a diagrammatic showing in longitudinal cross section of a suitable apparatus for carrying out the invention.
Figure 3:
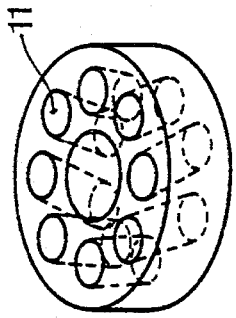
FIG. 3 is an enlarged perspective showing of an alternative embodiment of a vortex inducer.
Figure 2:
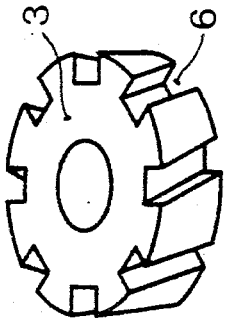
FIG. 2 is an enlarged perspective showing of a vortex inducer for use in FIG. 1.

The apparatus comprises a feed nozzle 1 (also referred to as a filament feed tube), a feed for the hot fluid medium 2 with a vortex inducer 3, a tubular chamber 4 (also referred to as the filament guide channel) and an expansion stage 5, shown as a slit nozzle in FIG. 1. FIG. 2 shows an embodiment of the vortex inducer 3. The hot fluid medium is passed through the channels 6, which are here in the form of grooves and which are arranged at an angle of from 10° to 70°, especially from 20° to 50° (more specifically, shown as 45° in the drawing), to the direction of motion of the filament bundle. The channels 6 in the vortex inducer 3 can for example be of square or rectangular cross-section; these embodiments are particularly easy to produce by milling the channels as grooves into the vortex-inducer body, which also serves as a centering body, so that the grooves in conjunction with the outer jacket 7 of the nozzle form channels. However, a vortical motion at the desired angle can also be imparted through channels 11 of round or oval cross-section, as are, for example, shown diagrammatically in FIG. 3. Yet again, the vortical motion can also be applied by providing only simple guide plates, which may be straight or curved. According to the invention, the vortex inducers are to be constructed so that the hot fluid medium acquires a vortex angle of from 10° to 70°, especially from 20° to 50°, and thus virtually flows at such an angle relative to the imaginary axis of the feed nozzle or of the tubular chamber, since these are normally arranged coaxially and the fluid medium flows around the said chamber.

The cross-sections of the channels in the vortex inducer can be varied within wide limits. However, it is advantageous if the channels are arranged symmetrically around the tubular chamber 4 and if the free surface area is from $\frac{1}{4}$ to $\frac{3}{4}$ of the annular surface area between the outer tube of the nozzle 7 and the tubular chamber 4. This annular surface area represents the free cross-sectional surface area around the yarn guide tube. The number of channels in the vortex inducer is advantageously from 4 to 12, preferably from 6 to 10. Even though this number is not a critical factor in the invention, it is advantageous to have from 6 to 10 channels. With fewer channels, the effect diminishes; with substantially more channels, of correspondingly smaller size, the manufacture of the device becomes more expensive.

The nozzle and the air guide device can be manufactured from any common metal or alloy of sufficient heat resistance and corrosion resistance. Stainless steel has proved particularly suitable.

The channels which determine the vortex direction are at an angle to the longitudinal axis and may be on the surface of an imaginary cylinder around the longitudinal axis of the tubular chamber or on the surface of a cone, so that the channels are inclined toward, or away from, this longitudinal axis. In other words, the individual streams of the hot fluid medium may impinge on one another over a smaller or larger circle than the circle corresponding to the mean radius of the annulus between the outer jacket and the tubular chamber 4. The vortex inducer can be in the immediate vicinity of the point at which the fluid medium and the travelling yarn bundle encounter one another, for example at a distance corresponding to the internal diameter of the jacket tube, or can also, though this is less effective, be located at a greater distance from this encounter point, for example at a distance equal to from 3 to 4 times the internal diameter of the jacket tube. The device according to the invention does not change the size of the texturizing nozzles used. For example, the nozzles disclosed in German Published Applications DAS No. 2,006,022 and DAS No. 2,331,045, with the dimensions stated there, are entirely suitable. The ratio of the internal diameter of the feed nozzle (ie. of the filament feed tube) to the internal diameter of the tubular chamber (ie. the filament guide tube) is expediently from 1:1.0 to 1:4, advantageously from 1:1.4 to 1:2.2. The ratio of these diameters, and the actual dimensions, depend on the thickness of the filament bundle which is to be crimped. In general, it is advantageous if the internal diameters are no greater than is necessary to allow transport of the yarn, so as to minimize the comsumption of fluid medium. For example, for filament bundles of 1,300 dtex, feed nozzle diameters of from 1.1 to 1.3 mm have proved suitable. The feed nozzle and the tubular chamber are arranged substantially coaxially at a distance from one another corresponding to from 0.1 to 3.0, preferably from 0.8 to 1.4, times the external diameter of the filament guide tube 4, in the specific case considered corresponding to a distance of from 0.3 to 1 mm, preferably from 0.4 to 0.5 mm. Downstream of the tubular chamber is an expansion zone which, when constructed as a slit nozzle, has the same internal width as the internal diameter of the tubular chamber. However, there can also be an abrupt or gradual transition to a larger diameter at the nozzle. It has proved advantageous if the nozzle has from 4 to 18 slits, with slit widths of from 0.3 to 1.0 mm, especially from 0.4 to 0.5 mm. However, other devices can also be used, provided they comprise a feed nozzle, annular gap, tubular chamber and expansion zone. The conventional process conditions for the particular nozzles also apply in respect of the relation between temperature of the heating medium and nature of the filament bundle. However, it has been found that using the invention, the temperature of the hot fluid medium can in general be from 10° to 20° lower than in the absence of a specific vortical motion.

In general terms, the process may be described as follows, with reference to FIG. 1: The filament bundle 8 is guided through the feed nozzle 1 into the texturizing nozzle, and the fluid medium 9 is introduced, via the feed 2 and the vortex inducer 3 into the gap 10 between the feed nozzle 1 and the tubular chamber 4. The vortex inducer imparts a vortical motion to the fluid medium, resulting, by virtue of the particular shape of the vortex inducer, in a vortex angle of from 10° to 70° relative to the axis of the filament guide tube or the filament bundle. In the apparatus shown in the drawing, the angle is about 45°. The range from 20° to 50° has proved particularly advantageous because it results in particularly favorable properties of the crimped yarn in respect of crimp rigidity, tenacity and elongation at break.

The filament bundle then continues to travel in the conventional way through the tubular chamber 4 and the expansion zone.

In the present context, filament bundles mean continuous structures of individual filaments, which may also be tapes, flat filaments or fibers produced by fibrillation of films or tapes. Furthermore, the individual filaments may be of round or profiled, for example trilobal, cross-section. The individual filaments may have a denier of from 1 to 30 dtex, preferably from 10 to 25 dtex. The number of individual filaments in the filament bundles or yarns may be from 2 to several thousands. The filaments in the filament bundles may be partially drawn or completely drawn. It is also possible to use filament bundles which have a pre-twist, for example of up to 30 turns per meter, especially of up to 25 turns per meter, which gives them better cohesion.

Suitable linear or virtually linear organic high molecular weight polymers for the production of the filaments are, in particular, conventional linear synthetic high molecular weight nylons with recurring carboxamide groups in the main chain, linear synthetic high molecular weight polyesters with recurring ester groups in the main chain, filament-forming olefin polymers, and cellulose derivatives, eg. cellulose esters. Specific examples of suitable high molecular weight compounds are nylon 6, nylon 6,6, polyethylene terephthalate, linear polyethylene and isotactic polypropylene.

The fluid gaseous medium used is a gas conventionally employed for this purpose, for example nitrogen, carbon dioxide, steam or, particularly for economic reasons, air. The temperature of the fluid medium can vary within wide limits. In general, a value of from 80° to 50° C. has proved advantageous, with the most favorable conditions for a particular material depending on the melting point or plasticizing temperature of the material, the speed of sound in the fluid medium at the particular temperature and pressure used, the time for which the fluid medium acts on the filament bundle, the temperature at which the filament bundle is fed in, and the thickness, ie. the denier, of the individual filaments. Of course, it is not possible to employ a temperature which causes the filament to melt under the chosen conditions, though the actual temperature may be above the melting point or decomposition point of the filament-forming material used, provided the filaments are passed through the treatment zone at a sufficiently high speed, ie. with a sufficiently low residence time. The higher the speed of travel, the greater the amount by which the temperature of the medium can be above the plasticization range, melting point or decomposition point of the filament-forming material used.

The plasticization ranges are, for example, 80°–90° C. for linear polyethylene, 80°–120° C. for polypropylene, 165°–190° C. for nylon 6, 120°–240° C. for nylon 6,6 and 190°–230° C. for polyethylene terephthalate.

The temperature of the fluid medium is in general higher than the plasticization temperature; for example, in the case of nylon 6, using air as the fluid medium, a temperature range of from 175° to 380° C. has proved suitable. For the other polymers, the lower limit of the preferred range is about 10° above the lower limit of the plasticization range and extends—depending on the residence time, and on the denier of the filaments—to about 200° above the said lower limit of the plasticization range.

The fluid medium is in general introduced under a pressure of from 2 to 15 bar, preferably from 5 to 9 bar.

The texturizing speed is from 1,200 to 3,000 m/min, preferably from 1,800 to 2,500 m/min. Higher speeds result in lower residence times which in turn permit higher temperatures of the fluid medium.

The vortex inducer which surrounds the tubular chamber (ie. the filament guide tube) represents the narrowest point of the free cross-section of the feed path of the medium. Advantageously, this free cross-section at the narrowest point is such as to give through-put rates of 0.35–2.0 cubic meters (S.T.P.) per hour per $mm^2$. These conditions result in particularly high take-off tensions at the supply points, for example the drawing godets. The amount of hot fluid medium to be employed also depends on the denier of the yarn, on the desired intensity of crimp and on the chemical nature of the filament bundle.

EXAMPLE 1

An undrawn nylon 6 feed yarn having a denier of 4200 f 67 dtex is taken off a supply package and fed to the pre-drawing device of a draw-texturizing machine, where it is drawn in a ratio of 1:3.45. The feed godet of the drawing zone is at 100° C. and the take-up godet at 150° C. The preheated and drawn filament is fed at a speed of 2,000 m/min to a crimping device of the type shown in FIG. 1. Air at 300° C. under a pressure of 5.3 bar is introduced through the tube nozzle 2, in an amount of 6.5 cubic meters (S.T.P.)/h, and is then passed through the eight circularly arranged air channels inclined counterclockwise at 40° to the axis of the texturizing device. The free cross-section of the annular space is 43 $mm^2$ and the free surface area of the eight air channels is 14.4 $mm^2$.

The yarn feed nozzle 1 has an internal diameter of 1.1 mm. The filament guide channel 4 has an internal diameter of 2.4 mm, an external diameter of 3.0 mm and a total length of 127 mm. This gives a ratio of the internal diameter of the feed nozzle 1 to the internal diameter of the filament guide channel 4 of 1:2.2. Between the feed nozzle 1 and the filament guide channel 4 there is an annular gap 10 of 0.4 mm. The cylindrical slit nozzle, of the type described in German Published Application DAS No. 2,006,022, is pushed onto the end of the filament guide channel 4. The distance between the end of the filament guide channel 4 and the start of the slit in the nozzle 5 is 0.83 times the external diameter of the filament guide channel. The expansion zone consists of a slit die 5 possessing twelve slits, with a slit width of 0.5 mm. The tension of the filament to be texturized is 65 cN upstream of the filament feed channel. The yarn has a crimp rigidity of 12.6% (hot water).

EXAMPLE 2

An undrawn nylon 6 feed yarn having a denier of 4200 f 67 dtex is taken off a supply package and fed to the pre-drawing device of a draw-texturizing machine, where it is drawn in a ratio of 1:3.45. The feed godet of the drawing zone is at 100° C. and the take-off godet at 150° C. The preheated and drawn filament is fed at a speed of 2,000 m/min to a crimping device of the type shown in FIG. 1. Air at 350° C. under a pressure of 5.3 bar is introduced through the tube nozzle 2, in an amount of 6.5 cubic meters (S.T.P.)/h, and is then passed through the eight circularly arranged air channels inclined counterclockwise at 15° to the axis of the texturizing device, and leaving free $\frac{1}{3}$ of the free cross-sectional area around the tubular chamber 4. The yarn feed nozzle 1 has an internal diameter of 1.1 mm. The filament guide channel 4 has an internal diameter of 2.4 mm and an external diameter of 3.0 mm, and a total length of 127 mm. This gives a ratio of the internal diameter of the feed nozzle 1 to the internal diameter of the filament guide channel 4 of 1:2.2. Between the feed nozzle 1 and the filament guide channel 4, there is an annular gap 10 of 0.4 mm. The cylindrical slit nozzle, of the type described in German Published Application DAS No. 2,006,022, is pushed onto the end of the filament guide channel 4. The distance between the end of the filament guide channel 4 and the start of the slit in the nozzle 5 is 0.83 times the external diameter of the filament guide channel. The expansion zone consists of a slit die 5 possessing twelve slits, with a slit width of 0.5 mm. The tension of the filament to be texturized is 45 cN upstream of the filament feed channel. The yarn has a crimp rigidity of 11.4% (hot water).

EXAMPLE 3

For comparison with Example 1, an undrawn nylon 6 feed yarn having a denier of 4200 f 67 dtex is taken off a supply package and fed to the pre-drawing device of a draw-texturizing machine, where it is drawn in a ratio of 1:3.45. The feed godet of the drawing zone is at 100° C. and the take-off godet at 150° C. The pre-heated and drawn filament is fed at a speed of 2,000 m/min to a crimping device which corresponds to that used in Examples 1 and 2 but does not comprise a vortex inducer 3. Air at 390° C. is introduced through the tube nozzle under a pressure of 5.3 bar. The air, in an amount of 4.7 cubic meters (S.T.P.)/h, is passed directly through the air gap between the yarn feed nozzle 1 and the filament guide channel 4. The air, before entering the air gap, in this case flows parallel to the filament guide channel, ie. without having a vortical motion induced into it.

The yarn feed nozzle 1 has an internal diameter of 1.1 mm. The filament guide channel 4 has an internal diameter of 2.4 mm and an external diameter of 3.0 mm, and a total length of 127 mm. This gives a ratio of the internal diameter of the feed nozzle 1 to the internal diameter of the filament guide channel 4 of 1:2.2. Between the feed nozzle 1 and the filament guide channel 4 there is an annular gap 10 of 0.3 mm. The cylindrical slit nozzle, of the type described in German Published Application DAS No. 2,006,022, is pushed onto the end of the filament guide channel 4. The distance between the end of the filament guide channel 4 and the start of the slit in the nozzle 5 is 0.83 times the external diameter of the filament guide channel. The expansion zone consists of a slit die 5 possessing twelve slits, with a slit width of 0.5 mm. The tension of the filament to be texturized is 30 cN upstream of the filament feed channel. The yarn has a crimp rigidity of 10.5% (hot water).

If the air is fed to the tube nozzle at a temperature of only 300° C., the yarn has a crimp rigidity of 8.2% (hot water).

We claim:

1. A process for texturizing bundles of filaments of synthetic high molecular weight materials, comprising passing the filament bundle through a feed nozzle and then a filament guide tube which is coaxial to said nozzle and is spaced therefrom by a gap, passing a hot fluid medium from a fluid medum inlet through a space surrounding said filament guide tube, in the direction opposite to the passage of the filaments through said guide tube, toward said gap so as to heat said filaments countercurrent-wise, imparting to said fluid medium incident to its passage through said space at a location in the immediate vicinity of said gap and over a lengthwise extent short compared with the overall length of said space between the fluid medium inlet and said gap, a vortical motion at a vortex angle of 10° to 70°, said space having an unobstructed cross section between said fluid medium inlet and said vortex imparting location so that the countercurrent-wise fluid flow completely surrounds said tube in transit to said location, causing the direction of flow of said medium to be reversed at said gap so as to entrain said filaments in their passage through said guide tube, and feeding the filaments subsequent to their passage through said guide tube, to an expansion stage to produce the crimp.

2. The process as claimed in claim 1, wherein the imparting step includes imparting to said fluid medium incident to its passage through said guide tube a vortical motion at a vortex angle of from 20° to 50°.

3. The process as claimed in claim 1, wherein the fluid medium at said vortex imparting location has, in the pressure range of from 2 to 15 bar and at a texturizing speed of from 1200 to 3000 m/min, a throughput rate of from 0.35 to 2.0 cubic meters (S.T.P.)/h per $mm^2$.

4. The process as claimed in claim 1, wherein said imparting step includes subdividing said space in the immediate vicinity of said gap, and over said relatively short extent, into 4 to 12 channels, each inclined to the axis of said space by an angle of from 10° to 70°, thereby to impart said vortical motion to said fluid medium incident to its passage through said space.

5. An apparatus for texturizing bundles of filaments of synthetic high molecular weight materials, comprising:

a jacket and, in this order, a feed nozzle for the filament bundle, a filament guide tube and an expansion stage, said feed nozzle and said filament guide tube being disposed, axially spaced from each other by a gap, coaxially within said jacket, an inlet for a hot fluid medium provided in said jacket downstream from said gap as viewed in the direction of travel of said filaments through said guide tube, for causing said fluid to flow in the space between said jacket and said guide tube, towards said gap to meet said filaments, said space being closed past said gap so that said fluid medium reverses its direction of flow at said gap, thereby to entrain said filaments in their travel through said guide tube, and means provided in said space at a point between said fluid medium inlet and said gap and inclined relatively to the axis of said space, for imparting a vortical motion to said fluid medium at a vortex angle of from 10° to 70°, said vortex imparting means being located in the immediate vicinity of said gap and having a length short compared with the overall length of said space between the fluid medium inlet and said gap, and said space having an unobstructed cross section between said fluid medium inlet and said vortex imparting means so that the countercurrent-wise fluid flow completely surrounds said guide tube in transit to said vortex imparting means.

6. An apparatus as claimed in claim 5, wherein said vortex imparting means are designed to impart to said fluid medium a vortical motion at an angle from 20° to 50°.

7. An apparatus as claimed in claim 5, wherein said vortex imparting means is in the form of a spacing and vortex-inducing disc having from 4 to 12 channels, each inclined relatively to the axis of said space by an angle of from 10° to 70°.

* * * * *

UNITED STATES PATENT AND TRADEMARK OFFICE

CERTIFICATE OF CORRECTION

PATENT NO. : 4,295,253

DATED : OCT. 20, 1981

INVENTOR(S) : KNOPP ET AL

It is certified that error appears in the above-identified patent and that said Letters Patent are hereby corrected as shown below:

On the face of the patent - line [73] Assignee: "BASF Aktiengesellschaft Ludwigshafen, Fed. Rep. of Germany"

should be

-- BASF Farben + Fasern AG Hamburg, Fed. Rep. of Germany --

Signed and Sealed this

*Twenty-third* Day of *March 1982*

[SEAL]

*Attest:*

GERALD J. MOSSINGHOFF

*Attesting Officer* *Commissioner of Patents and Trademarks*